US007971757B2

(12) United States Patent
Duquet et al.

(10) Patent No.: US 7,971,757 B2
(45) Date of Patent: Jul. 5, 2011

(54) LIQUID DISPENSER DEVICE

(75) Inventors: Frederic Duquet, Thibouville (FR); Jean-Paul Lecoutre, Conde sur Iton (FR)

(73) Assignee: Valois SAS, Le Neubourg (FR)

( * ) Notice: Subject to any disclaimer, the term of this patent is extended or adjusted under 35 U.S.C. 154(b) by 281 days.

(21) Appl. No.: 11/862,635

(22) Filed: Sep. 27, 2007

(65) Prior Publication Data

US 2008/0073379 A1 Mar. 27, 2008

Related U.S. Application Data

(60) Provisional application No. 60/871,584, filed on Dec. 22, 2006.

(30) Foreign Application Priority Data

Sep. 27, 2006 (FR) ..... 06 53964

(51) Int. Cl.
*B65D 88/54* (2006.01)

(52) U.S. Cl. ..... 222/321.3; 222/321.7; 222/380

(58) Field of Classification Search ..... 222/321.2, 222/321.7, 321.3, 321.1, 321.9, 207, 212, 222/213, 375, 380
See application file for complete search history.

(56) References Cited

U.S. PATENT DOCUMENTS 3,753,518 A * 8/1973 Kutik ..... 222/383.1
5,100,027 A * 3/1992 Gueret ..... 222/105
5,154,328 A * 10/1992 Gueret ..... 222/494
6,932,246 B2 * 8/2005 Crosnier et al. ..... 222/321.2
2005/0133534 A1 * 6/2005 Garcia ..... 222/153.12
2005/0135951 A1 * 6/2005 Garcia et al. ..... 417/437
2006/0261093 A1 * 11/2006 Laidler et al. ..... 222/207
2007/0164052 A1 * 7/2007 Julian Pidevall et al. ..... 222/207

FOREIGN PATENT DOCUMENTS

EP 0410857 A1 1/1991
EP 0410858 A2 1/1991
FR 2165571 A 8/1973
GB 1414637 A 11/1975

* cited by examiner

*Primary Examiner* — Kevin P Shaver
*Assistant Examiner* — Donnell Long
(74) *Attorney, Agent, or Firm* — Sughrue Mion, PLLC

(57) ABSTRACT

A liquid dispenser device for being associated with a liquid reservoir (R), said device comprising:

a chamber (10) provided with an inlet valve (5, 15), an outlet valve (32, 232), and a piston (3) that is suitable for varying the volume of the chamber;

a liquid dispenser orifice (25); and a pusher (2) that is axially displaceable down and up between a rest position and a depressed position;

the dispenser device being characterized in that the pusher (2) includes an elastically-deformable wall (212) that is thus displaceable relative to the remainder of the pusher, the piston (3) being in contact, at least momentarily, with the deformable wall (212), so as to be urged in displacement relative to the remainder of the pusher while the wall is being deformed, in such a manner as to open the outlet valve.

13 Claims, 1 Drawing Sheet

LIQUID DISPENSER DEVICE

CROSS REFERENCE TO RELATED APPLICATION

This application claims the benefit under 35 U.S.C. §119 (e) of pending U.S. provisional patent application Ser. No. 60/871,584, filed Dec. 22, 2006, and priority under 35 U.S.C. §119(a)-(d) of French patent application No. FR-06.53964, filed Sep. 27, 2006.

TECHNICAL FIELD

The present invention relates to a liquid dispenser pump that is generally associated with a liquid reservoir, which together constitute a liquid dispenser. It relates to a dispenser member that is generally actuated manually by means of a finger of the user. The liquid is dispensed in the form of a jet of fine spray droplets, a continuous stream, or even a knob of liquid, particularly for viscous liquids, such as cosmetic creams. Such a liquid dispenser member can be used in particular in the fields of perfumery, cosmetics, or even pharmacy for dispensing liquids that are viscous to a greater or lesser extent.

BACKGROUND OF THE INVENTION

The present invention relates more particularly, but not exclusively, to a type of pump that is commonly known as a "pusher-pump". Such a term is explained by the fact that the dispenser member includes a pusher that forms not only a dispenser orifice, but also defines a portion of a liquid chamber in which the liquid is put under pressure in selective manner. In some pumps, an inner surface of the pusher, of generally substantially cylindrical shape, serves as a sealing slide-cylinder for a piston of an outlet valve that is displaced with sealing contact inside the cylinder, thereby uncovering the dispenser orifice in selective manner. In general, the pistons are of the differential type, being displaced in response to a variation in the pressure of the liquid inside the chamber. Thus, in such a pusher-pump, there is a valve piston and a main piston that are displaceable in sealing contact in respective cylinders. The two pistons can be made integrally, and the unit as a whole can be referred to simply by the term "piston" comprising a main-piston lip and an outlet-valve lip.

In the prior-art, documents WO 97/23304, U.S. Pat. No. 4,050,613, and WO 2005/063405 are known that all describe pusher-pumps that operate on the above-defined principle. They all describe pumps comprising a pusher, a body that is mounted securely by means of a ring on the opening of a receptacle, and a differential piston that integrates the main-piston and valve-piston functions by forming a main-piston lip and one or two outlet-valve lips. The differential piston slides inside the pusher in response to a variation in pressure. The body, the pusher, and the differential piston together form a chamber. When the pressure increases in the chamber, the differential piston is displaced relative to the pusher. In addition, the inlet valve of the chamber is formed by a ball, a deformable-flap valve, or by the differential piston itself.

The problem that is encountered with that type of pump is priming the pump, i.e. filling the chamber for the first time with liquid coming from the reservoir. The above-mentioned prior-art documents do not deal with that problem. Unlike conventional dispensers in which the pump makes it possible to expel the air that is initially contained in the chamber to the inside the reservoir, very often this is not possible with pusher-pumps, since they are mounted on reservoirs of very small capacity. As a result, it is not possible to expel the air that is initially contained in the chamber into the reservoir, since the reservoir is completely full of liquid. Expelling the air into a reservoir of small capacity could result in the pump malfunctioning because of the raised pressure of the liquid stored in the reservoir. Consequently, the prior-art solution cannot be applied to small-capacity reservoirs, such as reservoirs on which pusher-pumps are generally mounted. More generally, an object of the present invention is to prime a liquid dispenser device in simple manner, without an additional step, and at low cost. The solution consisting in expelling the air into the reservoir is not possible.

BRIEF SUMMARY OF THE INVENTION

To achieve this object, the present invention proposes a liquid dispenser device for being associated with a liquid reservoir, said device comprising: a chamber provided with an inlet valve, an outlet valve, and a piston that is suitable for varying the volume of the chamber; a liquid dispenser orifice; and a pusher that is axially displaceable down and up between a rest position and a depressed position; the dispenser device being characterized in that the pusher includes an elastically-deformable wall that is thus displaceable relative to the remainder of the pusher, the piston being in contact, at least momentarily, with the deformable wall, so as to be urged in displacement relative to the remainder of the pusher while the wall is being deformed, in such a manner as to open the outlet valve. In an advantageous embodiment, the piston is a differential piston that is suitable for being displaced by the variations in the pressure of the liquid in the chamber, the piston being momentarily out of contact with the deformable wall of the pusher. When the pressure in the chamber is less than a predetermined threshold, the piston is advantageously in contact with the pusher by means of a return spring that urges the piston towards the pusher. The pusher advantageously defines a portion of the chamber. The outlet valve advantageously comprises a movable valve member and a valve seat, the valve member being secured in displacement with the piston. The pusher advantageously forms the valve seat of the outlet valve in such a manner that the displacement of the piston by deformation of the wall opens the outlet valve. The outlet valve is thus formed between the piston and the pusher, and, in normal operation, the piston is displaced in the pusher in response to an increase in pressure of the liquid in the chamber. However, when there is no liquid in the chamber, as is the situation before it is filled for the first time, the piston is not displaced in the pusher, since it only compresses the air. The pressure in the chamber thus does not reach the necessary threshold to cause the piston to be displaced in the pusher. Thus, in the prior-art documents, actuating the pusher before the chamber is filled for the first time with liquid has the effect only of compressing the air that is stored in the chamber. The outlet valve cannot open since the piston is not displaced in the pusher. By means of the present invention, it is possible to displace the piston relative to the portion of the pusher that defines the outlet-valve seat. This is made possible because the pusher includes the elastically-deformable wall that allows the piston to be displaced relative to the remaining portion of the pusher that defines the outlet-valve seat. The present invention is described herein as used in a pusher-pump, but it can be used in any type pump, or more generally in any type of liquid dispenser device in which a piston must be displaced relative to the pusher in order to open the outlet valve.

In an advantageous embodiment, the valve seat of the outlet valve comprises a valve slide-cylinder, the dispenser orifice being defined by the pusher at said cylinder. Advantageously, the device further comprises a body for being mounted on an opening of a reservoir, the body forming a cylinder for slidably receiving said piston that includes a piston lip in leaktight sliding contact in the piston-receiving cylinder, a valve lip in sliding contact in the valve cylinder, and an abutment surface in contact with the deformable wall.

In another aspect of the invention, the pusher comprises a bearing plate on which a user can exert pressure by means of a finger, and a peripheral skirt forming the dispenser orifice, the deformable wall being formed in the plate, advantageously by reducing the wall thickness of the plate. The skirt advantageously comes into abutment against the body in the depressed position, the deformable wall thus deforming so as to displace the piston and thus open the outlet valve. The piston is advantageously in contact with the wall in the depressed position. The deformable wall advantageously presents resistance to deformation that is greater than the force exerted by the spring, and greater than or equal to the maximum pressure existing in the chamber. The wall advantageously deforms after the pusher has reached its depressed position.

Thus, the deformable wall of the pusher is not deformed during normal operation of the pump once it has been primed. The deformable wall is used only for priming by pressing down hard on the pusher. Thereafter, the forces experienced by the pump during its normal operation are not sufficient to cause the wall to deform. Naturally, if the user presses down very hard on the pusher while it is in its depressed position, then the wall of the pusher will deform. However, in normal conditions of use, the wall remains static. The wall of the piston can be deformed automatically just after the dispenser has been filled and closed, or it can be deformed by the user when the dispenser is used for the first time. The deformable wall can also serve as a first-use guarantee, indicating to the user that the dispenser device has not been used beforehand.

BRIEF DESCRIPTION OF THE DRAWINGS

The invention is described more fully below with reference to the accompanying drawings which show an embodiment of the invention by way of non-limiting example.

In the figures.

DETAILED DESCRIPTION OF THE INVENTION

Figure 2:
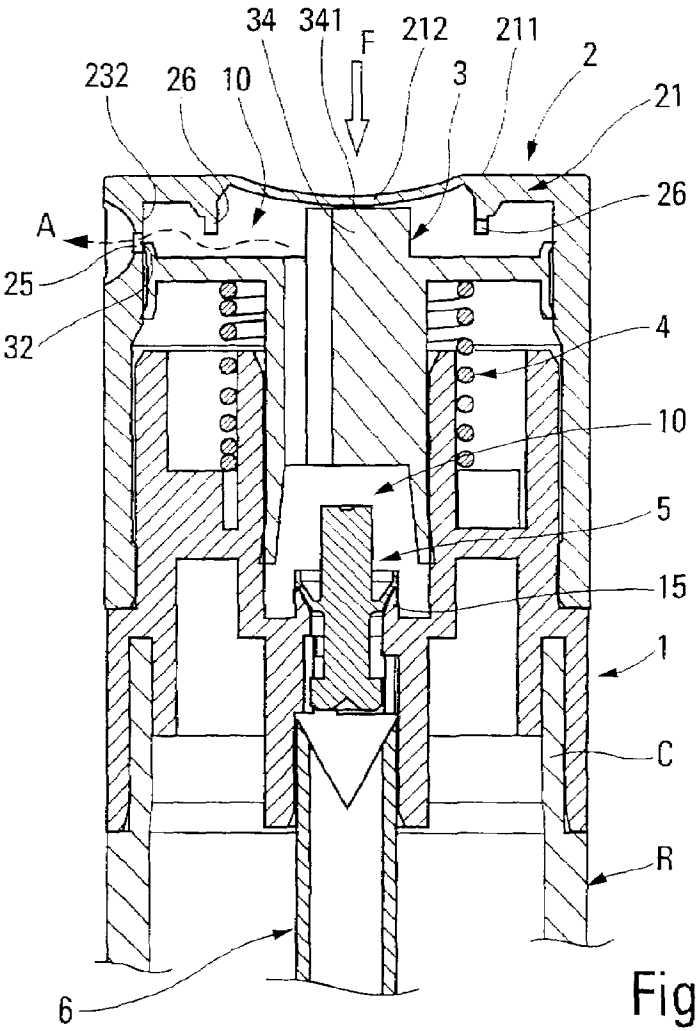
FIG. 2 is a view similar to the view in FIG. 1 but shown in the depressed position in order to perform priming.

The dispenser device of the figures is a pump that is shown associated with a receptacle R including a neck C on which the dispenser device of the invention is fastened.

The pump comprises five component elements, namely a body 1, a pusher 2, a piston 3, a spring 4, and an inlet valve member 5 The pump can further comprise a dip tube 6. The body, the pusher, the piston, the valve member 5, and the dip tube 6 are preferably made by molding a plastics material. The pump includes a pump chamber 10.

The body 1 includes a fastener ring 11 that co-operates with the neck C, so as to fasten the pump on the receptacle R. The ring 11 is engaged with the outside of the neck. In addition, the body forms a self-sealing lip 12 that is in leaktight engagement with the inside wall of the neck. The body 1 also forms a guide bushing 14. The body also forms a main piston-receiving cylinder 17 that internally defines a leaktight sliding surface having a function that is explained below. The body also forms an inlet sleeve 16 that forms an inlet valve seat 15. The dip tube 6 is connected to the sleeve 16 that has an inlet duct 18 passing therethrough. The inlet sleeve 16 extends below the main cylinder 17 and is cylindrical about the same axis.

The body 1 is circularly symmetrical about an axis X that extends longitudinally along the central axis of the inlet duct 18.

This is a particular design for a particular body of a dispenser device constituting an embodiment of the invention. Naturally, the body can present characteristics other than the characteristics described above, without going beyond the ambit of the invention.

The pusher 2 forms a dispenser head for the pump. The pusher 2 comprises a bearing plate 21, and a peripheral skirt 22 that extends downwards from the outer periphery of the bearing plate. Thus, the pusher 2 is generally in the shape of an upsidedown bucket, with the bearing plate forming its bottom, and the skirt forming its cylindrical side wall. However, the skirt is not necessarily of cylindrical shape. It could present sections that are frustoconical or rounded.

The bearing plate 21 includes a bearing zone 211 on which it is possible to press by means of one or more fingers. In the invention, the plate includes an elastically-deformable wall 212 that is situated in the bearing zone 211. It is possible to say that the bearing zone contains the deformable wall. In this embodiment, the deformable wall 212 is made by reducing the wall thickness of the plate 21. The wall 212 can also be made with a plastics material that is more flexible than the remainder of the pusher, e.g. by using a dual-injection method or an overmolding method. The wall 212 is centered on the axis X. The wall 212 is thus displaceable by deforming relative to the remainder of the pusher.

The skirt 22 comprises a top dispenser wall 23 and a bottom guide wall 24. The top end of the dispenser wall 23 is connected to the outer periphery of the bearing plate 21. The dispenser wall 23 includes an outer surface 231 and an inner surface 232. The inner surface 232 is preferably circularly cylindrical and defines an outlet-valve slide-cylinder as described below. In addition, the dispenser wall 23 is formed with a through dispenser orifice 25 that extends between its inner and outer surfaces. The dispenser orifice 25 can open out to the outer surface in a diffuser dish 251.

According to an advantageous characteristic of the invention, the inner wall 232 of the dispenser wall 23 is formed with a swirl system that makes it possible to turn the liquid in the form of a swirl having an eye that is centered on the dispenser orifice.

The guide wall 24 includes an abutment bead 241 on its inner surface for co-operating with the guide bushing 14. The abutment bead 241 makes it possible to secure the pusher to the body, with said pusher thus being axially displaceable over no more than a determined maximum stroke.

In this embodiment, the piston 3 comprises a main piston in the form of a lip 36 that is engaged to slide in leaktight manner inside the cylinder 17, and a valve piston formed by two lips 32 and 33 that are in leaktight sliding contact in the cylinder formed by the inner surface 232 of the dispenser wall 23. The piston 3 is advantageously made as a single part. The piston 3 is a differential piston that is displaced in response to pressure variations in the chamber. The top lip 32 is in contact with the inner surface 232 above the dispenser orifice 25, whereas the bottom lip 33 is in contact with the inner surface 232 below the orifice 25. This represents the rest position in which the piston 3 is urged against the bearing plate 21 by the spring 4 which bears firstly against the body, and secondly below an annular flange 31 formed by the piston 3. In addition, the two lips 32 and 33 are formed on the outer periphery of the flange 31. At its center, the flange forms an abutment stud 34 that defines a surface 341 for contacting the deformable wall 212 of the pusher. The piston of the differential valve can be thought of as being formed by the flange 31 forming the two lips 32 and 33. In addition, the piston 3 forms a rod 35, at the bottom end of which there is formed the piston lip 36 that acts as the main piston. The lip is engaged to slide in sealed manner in the cylinder 17 of the body. The rod has a connection channel 37 passing therethrough, which connection channel connects the piston lip 36 to the flange 31. The top end of the rod is formed by the stud 34, and its bottom end is formed by the lip 36.

Figure 1:
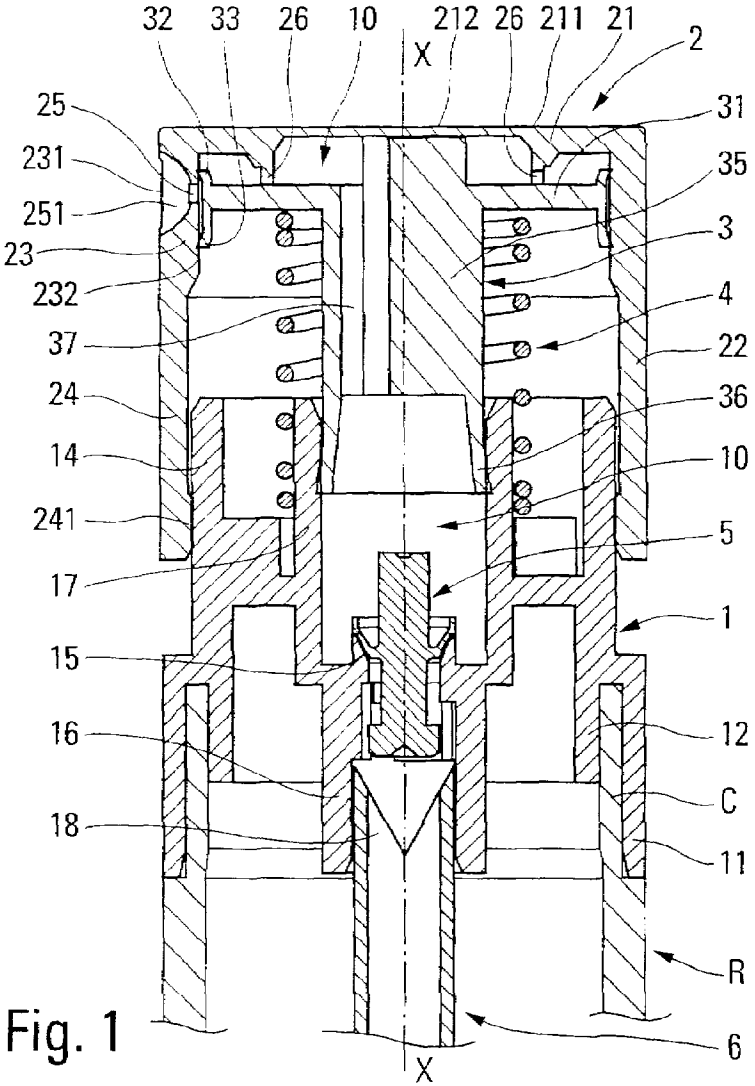
FIG. 1 is a vertical section view through a liquid dispenser device constituting an embodiment of the invention and shown in the rest position.

The body 1, the pusher 2, and the piston 3 together form a pump chamber 10 that extends continuously inside the main cylinder 17, through the connection channel 37, and between the plate 21 and the flange 31. In the rest position shown in FIG. 1, the spring 4 pushes the piston 3 into abutment against the deformable wall. The inlet valve is closed. The two lips 32 and 33 of the differential piston are in contact with the cylinder formed by the inner surface 232 of the dispenser wall 23.

By exerting a force on the bearing zone 211, the pusher is displaced axially relative to the body 1. Given that the piston is in abutment against the wall 212, it is pushed by the pusher. Initially, the displacement of the pusher causes the inlet valve to be pressed down. The pump chamber 10 is thus isolated from the reservoir R. From that moment on, the liquid in the pump chamber 10 is put under pressure. As a result of the liquid being incompressible, the total working volume of the pump chamber must necessarily remain constant. But since the main piston 36 is pushed down into the cylinder 17, thereby reducing the volume of the bottom portion of the chamber, a new volume must be created. This is possible as a result of the differential piston moving away from the bearing plate 21. This causes the lips 32 and 33 to slide inside the dispenser wall 23. The lips are thus displaced until the top lip 32 reaches the dispenser orifice. At that moment, the liquid under pressure in the pump chamber finds an outlet passage through the dispenser orifice. The passage thus remains open for as long as the pressure inside the chamber is able to overcome the force of the spring 4. When the pressure inside the chamber drops below a certain threshold, the spring 4 pushes the piston towards the rest position shown in FIG. 1. The dispenser orifice is then once again isolated from the pump chamber. This corresponds to a normal operating cycle for the pump once it has been primed, i.e. with its chamber full of liquid.

In contrast, when the chamber 10 does not contain any liquid and is full only of air, which is the situation before it is used for the first time after manufacture and assembly, the operating cycle is not possible, given that the pressure inside the chamber has not reached the threshold that is sufficient and necessary to displace the piston inside the pusher. Air is a compressible medium in contrast to liquids that are incompressible. It is thus possible to actuate the pusher without the chamber being emptied of its air. This is the situation with prior-art devices, but this drawback is remedied in the present invention by the presence of the elastically-deformable wall 212 of the pusher. With reference to FIG. 2, the pump can be seen in its completely-depressed position, with its spring 4 compressed to its maximum. The chamber 10 is at its minimum volume. The skirt of the pusher comes into abutment against the fastener ring 11 of the body. Then, by pressing down hard on the deformable wall 212 of the pusher 2, said wall deforms by curving inwards. The force is represented in FIG. 2 by arrow F. Given that the abutment stud is in contact with the wall 212, the piston 3 is displaced axially downwards. In other words, the piston 3 is displaced relative to the remainder of the pusher, as a result of it being urged by the deformable wall 212 that is also displaced relative to the remainder of the pusher. This causes the lips 32 and 33 to slide inside the cylinder formed by the pusher. By deforming the wall 212 enough, the top lip 32 uncovers the dispenser orifice 25 a little, thereby creating an escape passage for the air under pressure inside the chamber. This is shown in FIG. 2, and the escape of air is represented by dashed arrow A. It is not necessary for the lip 32 to uncover the orifice 25 completely: it suffices for a small gap to exist, so as to enable the air under pressure to escape to the outside through the orifice 25. The chamber 10 is thus emptied of the air that was initially trapped inside. When the bearing force F decreases, the deformable wall 212 returns to its non-deformed state, which once again closes the passage between the lip 32 and the orifice 25. The chamber is thus once again isolated from the outside, and a vacuum is created as the spring 4 relaxes so as to return the piston and the pusher to the rest position of FIG. 1. The vacuum generated causes the valve member 5 of the inlet valve to rise, and liquid coming from the reservoir is then able to rise through the dip tube 6 and penetrate into the chamber 10 that begins to fill with liquid for the first time.

It should also be observed that the bearing plate 21 forms an abutment ring 26 against which the flange 31 of the piston 3 rests in the rest position. The ring 26 takes up a fraction of the bearing force generated by the spring 4 and that is exerted by the stud 34 against the wall 212. In the depressed priming position shown in FIG. 2, the ring 26 is not in contact with the flange 31.

The deformable wall 212 advantageously presents resistance to deformation that is greater than the force exerted by the spring 4, and greater than or equal to the pressure existing inside the chamber 10. It is preferable for the wall 212 not to deform under normal operating conditions of the pump. In other words, once the pump is primed, the user normally no longer needs to deform the wall 212 when pressing on the pusher so as to dispense the liquid. For this, it suffices to make the wall 212 with sufficient wall thickness. Naturally, if the user presses very hard on the wall 212 in the depressed position, said wall will deform, but said deformation will have no effect on the operation of the pump, given that the pump chamber 10 will already have been emptied of its content. By releasing the bearing force, the wall 212 initially returns to its non-deformed position, and it is only after this that the spring 4 begins to relax.

Thus by means of the deformable wall of the pusher, it is possible to open the outlet valve, and to create an escape passage for the air that is initially held captive in the pump chamber.

The invention claimed is:

1. A liquid dispenser device for being associated with a liquid reservoir (R), said device comprising:

a chamber (10) provided with an inlet valve (5, 15), an outlet valve (32, 232), and a piston (3) that is suitable for varying the volume of the chamber, wherein the outlet valve comprises a movable valve member (32) and a valve seat (232), the valve member being secured in displacement with the piston (3); and a pusher (2) including a liquid dispenser orifice (25) and an elastically-deformable wall (212) that is displaceable relative to the liquid dispenser orifice (25), wherein said pusher is axially displaceable down and up between a rest position and a depressed position, wherein, in operation, deformation of the deformable wall (212) relative to the liquid dispenser orifice (25) displaces the piston relative to the liquid dispenser orifice, thereby opening the outlet valve.

2. A dispenser device according to claim 1, in which the piston (3) is a differential piston that is configured to be displaced by variations in the pressure of the liquid in the chamber, the piston being momentarily out of contact with the deformable wall of the pusher.

3. A dispenser device according to claim 1, in which, when the pressure in the chamber (10) is less than a predetermined threshold, the piston (3) is in contact with the pusher (2) by a return spring that urges the piston towards the pusher.

4. A dispenser device according to claim 1, in which the pusher (2) defines a portion of the chamber (10).

5. A dispenser device according to claim 1, in which the pusher (2) forms the valve seat (232) of the outlet valve in such a manner that the displacement of the piston (3) by deformation of the wall (212) opens the outlet valve.

6. A dispenser device according to claim 5, in which the valve seat of the outlet valve comprises a valve slide-cylinder (232), the dispenser orifice (25) being defined by the pusher (2) at said cylinder.

7. A dispenser device according to claim 6, further comprising a body (1) for being mounted on an opening (C) of a reservoir (R), the body (1) forming a cylinder (17) for slidably receiving said piston (3) that comprises a piston lip (36) in leaktight sliding contact in the piston-receiving cylinder (17), a valve lip (32) in sliding contact in the valve cylinder (232), and an abutment surface (341) in contact with the deformable wall (212).

8. A dispenser device according to claim 1, in which the pusher (2) comprises a bearing plate (21) on which a user can exert pressure by a finger, and a peripheral skirt (22) forming the dispenser orifice (25), the deformable wall (212) being formed in the plate (21).

9. A dispenser device according to claim 8, in which the skirt (22) comes into abutment against the body (1) in the depressed position, the deformable wall (212) thus deforming so as to displace the piston (3) and thus open the outlet valve.

10. A dispenser device according to claim 1, in which the piston (3) is in contact with the wall (212) in the depressed position.

11. A dispenser device according to claim 1, in which the wall deforms after the pusher has reached its depressed position.

12. A dispenser device according to claim 2, in which, when the pressure in the chamber (10) is less than a predetermined threshold, the piston (3) is in contact with the pusher (2) by a return spring that urges the piston towards the pusher.

13. The dispenser device according to claim 8, wherein the pusher comprises a bearing plate upon which a user exerts pressure by a finger, and a peripheral skirt forming the dispenser orifice, the deformable wall is formed in the plate by a reduced wall thickness of the plate.

* * * * *